US006983928B2

(12) United States Patent
Araki

(10) Patent No.: US 6,983,928 B2
(45) Date of Patent: Jan. 10, 2006

(54) ACCELERATION APPARATUS FOR CARBURETOR

(75) Inventor: Satoru Araki, Iwate-Gun (JP)

(73) Assignee: Zama Japan, (JP)

( * ) Notice: Subject to any disclaimer, the term of this patent is extended or adjusted under 35 U.S.C. 154(b) by 151 days.

(21) Appl. No.: 10/652,828

(22) Filed: Aug. 28, 2003

(65) Prior Publication Data

US 2004/0130040 A1 Jul. 8, 2004

(30) Foreign Application Priority Data

Sep. 12, 2002 (JP) ..... 2002-266321

(51) Int. Cl.
*F02M 7/08* (2006.01)
*F02M 9/02* (2006.01)

(52) U.S. Cl. ..... 261/34.2; 261/44.6; 261/44.8

(58) Field of Classification Search ..... 261/34.2, 261/44.6, 44.8, 50.1, 50.2
See application file for complete search history.

(56) References Cited

U.S. PATENT DOCUMENTS 2,796,242 A * 6/1957 Sarto ..... 261/34.2
3,640,512 A * 2/1972 Morgenroth ..... 261/34.2
4,000,223 A * 12/1976 Yoshioka et al. ..... 261/34.2
4,247,491 A * 1/1981 Tamaki et al. ..... 261/34.2
6,231,033 B1 * 5/2001 Araki ..... 261/44.8
6,343,780 B1 * 2/2002 Nakazato ..... 261/34.2

FOREIGN PATENT DOCUMENTS

| | | | |
|---|---|---|---|
| JP | 53-81831 | | 7/1978 |
| JP | 58-133459 | * | 8/1983 |
| JP | 2-123269 | * | 5/1990 |
| JP | 6-67842 | | 9/1994 |

* cited by examiner

*Primary Examiner*—Richard L. Chiesa
(74) *Attorney, Agent, or Firm*—Orrick, Herrington & Sutcliffe LLP

(57) ABSTRACT

An accelerator for a carburetor that is linked to a throttle valve and allows a piston-type accelerator pump to be operated in a simple configuration that dispenses with a link mechanism and does not greatly enlarge the carburetor. The lower surface of a throttle valve lever (10) is provided with a cam (33) that has a circular shape centered about a throttle valve stem (8) and is configured such that the cam surface (33A) thereof faces a carburetor main body (1). An accelerator pump (25) is placed parallel to the throttle valve stem (8) and the upper end of a piston rod (28) thereof is brought into contact with the cam surface (33A). The cam (33) pushes the piston rod (28) down as the throttle valve lever (10) swings in the opening direction of the throttle valve, and the acceleration fuel in the pump chamber (29) is delivered and supplied to the suction channel (2).

29 Claims, 4 Drawing Sheets

ACCELERATION APPARATUS FOR CARBURETOR

FIELD OF THE INVENTION

The present invention relates to an acceleration apparatus in a carburetor used primarily to supply fuel to general-purpose engines.

BACKGROUND OF THE INVENTION

It is well known in the art that extra fuel, that is, acceleration fuel, is supplied to the suction channel in response to the rapidly increasing quantity of suction air when the degree of opening of the throttle valve is enlarged to increase the rotational speed of the engine.

A carburetor, which is one type of fuel supply system, may comprise an acceleration apparatus having a piston-type (or a diaphragm-type) acceleration pump linked to a throttle valve, for example, a carburetor for an automobile engine, as cited in Japanese Patent Application Laid-open No. 53-81831. This acceleration device delivers and supplies acceleration fuel to the suction channel by transmitting the rotation of the throttle valve to the piston (or diaphragm) of the acceleration pump by means of a link mechanism.

Despite the fact that the acceleration apparatus described above is easily applied to a carburetor having a butterfly-type throttle valve, providing the link mechanism described above to the exterior of the carburetor main body in a carburetor for general-purpose engines not only unavoidably results in greater complexity and significantly greater size, which is contrary to basic needs and characteristics that the structure be small and simple, but also makes it essentially impossible to apply such an apparatus to a rotating throttle valve-type carburetor often used in general-purpose engines, because the throttle valve moves in the axial direction while rotating.

As a result, it has been proposed that an acceleration apparatus be provided to a rotating throttle valve-type carburetor, as cited in Japanese Utility Model Application Laid-open No. 6-67842, such that a piston-type acceleration pump is disposed at a right angle to the throttle valve stem. The piston is operated by a cam formed on the external peripheral surface of the throttle valve to deliver and supply acceleration fuel to the suction channel.

The acceleration apparatus provided to the rotating throttle valve-type carburetor described above does not have a complex link mechanism on the exterior to change the rotating movement of the throttle valve to the linear movement of the acceleration pump. However, very troublesome fabrication is required in that a cam in the form of a groove extending in the circumferential direction must be formed on the external peripheral surface of the cylindrical throttle valve so that the acceleration fuel corresponds to the quantity of the suction air. The cam in the form of a groove additionally raises concern that the airtightness of the external peripheral surface of the throttle valve may be impaired, and that air may be sucked into the suction channel during idling depending on the formation site, resulting in a malfunction in idling.

SUMMARY OF THE INVENTION

The present invention has a simple structure, and provides a solution to the problems described above; primarily, to provide an acceleration apparatus that could be mounted, in particular, in a carburetor for a general-purpose engine without concern that the resulting construction will become significantly bulkier or that the function thereof will become impaired.

The present invention provides a solution to the above-stated problems in an acceleration apparatus for a carburetor having a piston-type acceleration pump linked to the throttle valve. In a first embodiment, the portion of a throttle valve stem that protrudes to the exterior of a carburetor main body is provided with a cam whose circular shape is centered about the throttle valve stem and whose cam surface faces the carburetor main body. In the acceleration pump, a piston rod extends from a piston mounted in a cylinder chamber formed inside the carburetor main body is extended to the exterior of the carburetor main body and is disposed parallel to the throttle valve stem. Acceleration fuel is delivered and supplied to a suction channel from the cylinder chamber by the cam pushing the piston rod along the cam surface as the throttle valve rotates in the opening direction of the throttle valve stem.

The cam provided on the throttle valve stem which directly pushes the piston rod to deliver and supply acceleration fuel, has a simple configuration that dispenses with a link mechanism, does not greatly enlarge the carburetor, and allows an accelerator to be obtained without concern for impairing the function of the carburetor.

To solve the above-stated problems in an acceleration apparatus for a carburetor having a piston-type acceleration pump linked to the throttle valve in the same manner as above, in a second embodiment of the present invention, the portion of a throttle valve stem that protrudes to the exterior of a carburetor main body is provided with a first cam whose circular shape is centered about the throttle valve and whose cam surface faces the carburetor main body, and a second cam whose cam surface is parallel to the cam surface of the first cam and which faces in the opposite direction. In the acceleration pump, a piston rod extending from a piston mounted in a cylinder chamber formed inside the carburetor main body is extended to the exterior of the carburetor main body and is disposed parallel to the throttle valve stem. The piston rod is provided with a first contact portion and a second contact portion that contact the cam surfaces of the first cam and second cam. Acceleration fuel is delivered and supplied to a suction channel from the cylinder chamber by the first cam pushing the first contact portion along the cam surface thereof as the throttle valve rotates in the opening direction of the throttle valve stem, and fuel is suctioned to replenish the cylinder chamber by the second cam pushing the second contact portion along the cam surface thereof as the throttle valve rotates in the closing direction.

The reciprocating movement of the piston is performed by the first cam and second cam, so a piston spring in the acceleration pump is unnecessary. In addition to the effects provided by the first means, an acceleration apparatus can be obtained whereby the length of the cylinder chamber is shortened, the acceleration pump can be made small, and the piston can be lengthened to stabilize the reciprocating movement.

DESCRIPTION OF THE PREFERRED EMBODIMENTS

Figure 1:
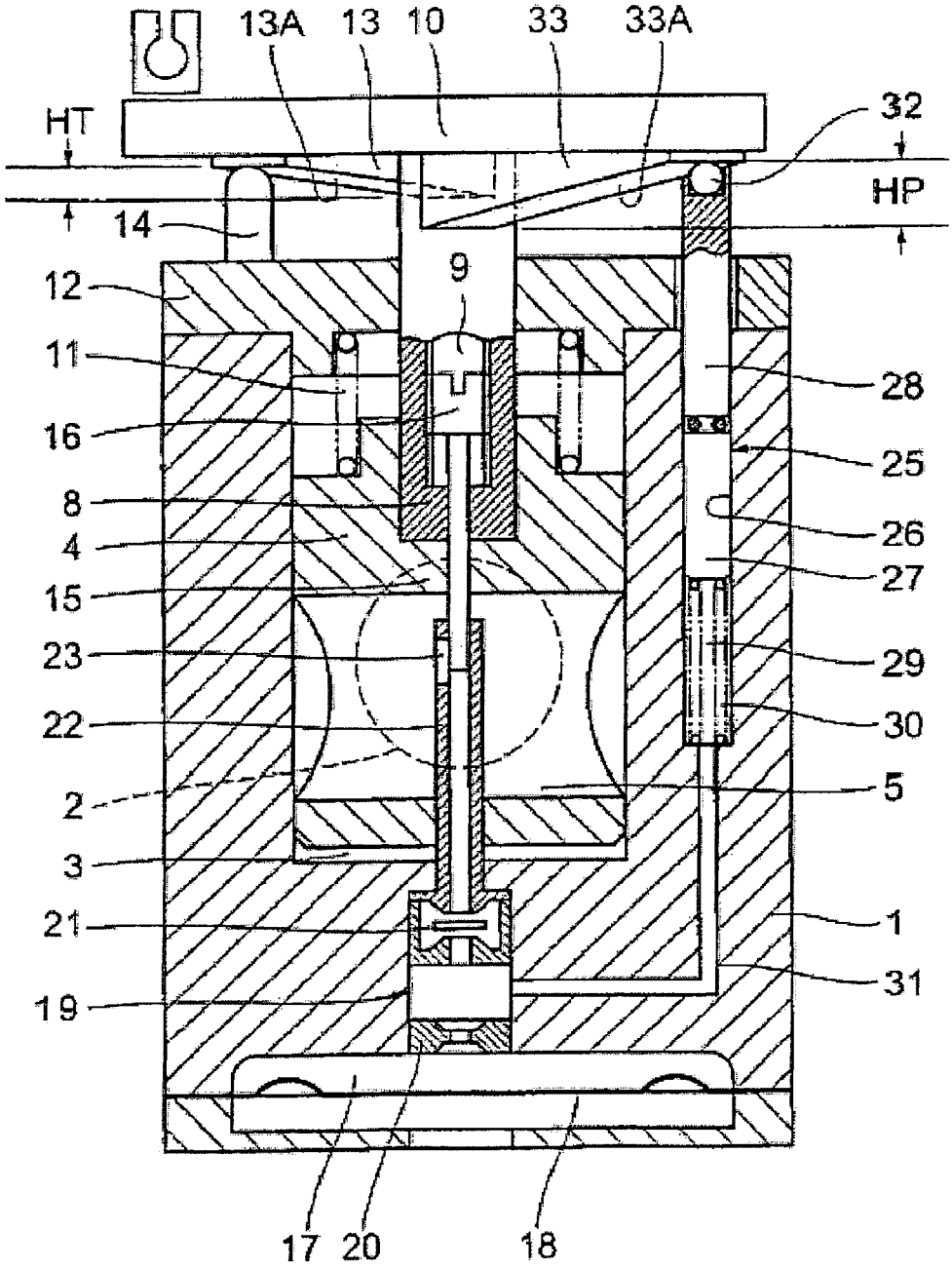
FIG. 1 is a longitudinal section showing an embodiment of the present invention.

Describing the present invention with reference to the diagrams, FIG. 1 is a longitudinal section showing an embodiment in which the present invention has been applied. The carburetor main body 1 has a suction channel 2 that extends in the transverse direction. A cylindrical valve hole 3 that is orthogonal thereto, extends in the transverse direction, and is sealed at the lower end. A cylindrical throttle valve 4 is fitted into the valve hole 3 while allowed to rotate and move in the axial direction.

The throttle valve 4 has a throttle through-hole 5 that is set orthogonally to the center axis line thereof and has substantially the same diameter as the suction channel 2, and further has a metering needle 15 and a throttle valve stem 8 positioned on the center axis line. The throttle valve stem 8 is fixedly fitted in the top portion of the throttle valve 4, blocks the open end of the valve hole 3, passes completely through the cover body 12 mounted on the upper surface of the carburetor main body 1, protrudes to the exterior, and is fixed to a throttle valve lever 10 at the protruding end.

In the space between the throttle valve 4 of the throttle hole 3 and the cover body 12, a valve-closing spring 11 comprising a torsion coil spring fixed to both ends thereof is internally mounted in a compressed state around the throttle valve stem 8. A fuel control cam 13 comprising a circular end surface cam centered about the throttle valve stem 8 is formed in a protruding configuration on the lower surface of the throttle valve lever 10, and the cam surface 13A facing downward therefrom is placed in contact with a contact piece 14 protruding from the cover body 12. The metering needle 15 is further attached facing downward to the throttle valve stem 8 by threadably mounting a male screw head body 16 at the base end into the female screw hole 9 of the throttle valve stem 8, and is extended from the upper portion into the throttle through-hole 5 in a manner that allows the length of the protrusion to be adjusted.

A constant fuel chamber 17, which is cut off from the atmosphere by a diaphragm 18, is disposed on the lower surface of the carburetor main body 1, holds a fixed quantity of fuel delivered from the fuel tank by way of a fuel pump (not depicted). The fuel from the constant fuel chamber 17 passes through a primary jet 20 that defines the maximum fuel flow rate from the fuel channel 19, a check valve 21 that prevents air inflow to the constant fuel chamber from the suction channel 2, and a pipe-shaped fuel nozzle 22, and is then delivered to the interior of the throttle through-hole 5 by way of a nozzle aperture 23 disposed on the peripheral side surface thereof. The fuel nozzle 22 protrudes from the lower portion into the throttle through-hole 5 disposed on the center axial line of the throttle valve 4, the leading end portion of the metering needle 15 is inserted therein, and the aperture surface area of the nozzle aperture 23 is made variable.

FIG. 1 shows the condition during idling. When the driver turns the throttle valve lever 10 by operating the accelerator, the throttle valve 4 rotates in an integral manner while twisting the valve-closing spring 11, and the suction airflow rate is increased by enlarging the degree of overlap with the suction channel 2 and the throttle through-hole 5. At the same time, the contact piece 14 in contact with the cam surface 13A pushes up the throttle valve lever 10, the throttle valve stem 8, and the throttle valve 4 in accordance with the increase in the height of the fuel control cam 13, and the fuel flow rate is increased by reducing the insertion depth of the metering needle 15 into the fuel nozzle 22 and enlarging the aperture surface area of the nozzle aperture 23. When the accelerator operation is lessened or released, the contact piece returns to the idling position along the cam surface 13A by the action of the valve-closing spring 11. The above description is the same as for conventional rotary throttle valve-type carburetors.

In the acceleration pump 25 comprising the acceleration apparatus of the present invention, a rod-shaped member of uniform diameter, with the top side serving as a piston rod 28 and the lower side serving as a piston 27, is fitted into a cylinder chamber 26 that extends in the vertical direction and is sealed at the lower end. The space below the piston 27 of the cylinder chamber 26 is connected to the fuel channel 19 between the check valve 21 and the primary jet 20 by way of a conduit 31 to form a pump chamber 29 in which a piston spring 30 comprising a compression coil is mounted. The piston rod 28 is extended completely through the cover body 12 above the carburetor main body 1 and is disposed parallel to the throttle valve stem 8.

A cam 33 comprising a circular end surface cam centered about the throttle valve stem 8 is formed in a protruding configuration on the lower surface of the throttle lever 10. A contact portion 32, comprising a sphere rotatably mounted and held on the upper end of the piston rod 28, is kept in constant contact with the downward facing cam surface 33A of the cam 33 by means of the piston spring 30.

During idling, the contact portion 32 is in contact with the lowest portion of the cam surface 33A, as shown in FIG. 1. This reduces the friction resistance by rolling in contact with the cam surface 33A when the throttle valve lever 10 turns due to the driver operating the accelerator, and prevents bending of the piston rod 28 and any wear due to direct contact. The piston rod 28 and the piston 27 integrated therewith are pushed downward as the height of the cam 33 increases, and acceleration fuel from the pump chamber 29 is delivered and supplied to the suction channel 2 from the nozzle aperture 23 by way of the conduit 31 and fuel channel 19. When the throttle valve lever 10 is returned in the direction of the idling position by a reduction or release in the accelerator operation, fuel from the constant fuel chamber 17 is suctioned to replenish the pump chamber 29 from the fuel channel 19 and the conduit 31 by means of the piston spring 30 pushing up the piston 27 and the piston rod 28 in preparation for the subsequent throttle-opening action, that is, acceleration operation.

According to the present embodiment, the piston rod 28 and the cam 33 are disposed in the space between the throttle lever 10 and the cover body 12. The piston rod 28 is directly moved in a straight line by means of the cam 33 that moves in the circumferential direction in association with the rotation of the throttle valve 8. The structure is very simple because a mechanism that enlarges the carburetor overall or that is externally disposed is dispensed with, allowing the components to be accommodated in conventionally available space.

In the present embodiment, when the throttle valve 4 rotates from the idling position to the completely open position, the contact location on the cam surface 13A of the contact piece 14 moves from the lowest portion in the idling position to the highest portion in the completely open position. The difference in height $H_T$ is the quantity of movement of the metering needle 15. In order for the acceleration pump 25 to supply and deliver acceleration fuel to the suction channel 2, the piston 27 must be pushed downward despite the throttle lever 10 moving upward by $H_T$. For this reason, the difference in height $H_P$ between the location in which the cam surface 33A is in contact with the contact portion 32 in the idling position, and the contact location in the completely open position in the present embodiment is made larger than $H_T$, and the difference $H_P$–$H_T$ is set to the maximum stroke of the piston 27. This approach allows acceleration fuel to be reliably delivered and supplied to the suction channel 2.

Figure 2:
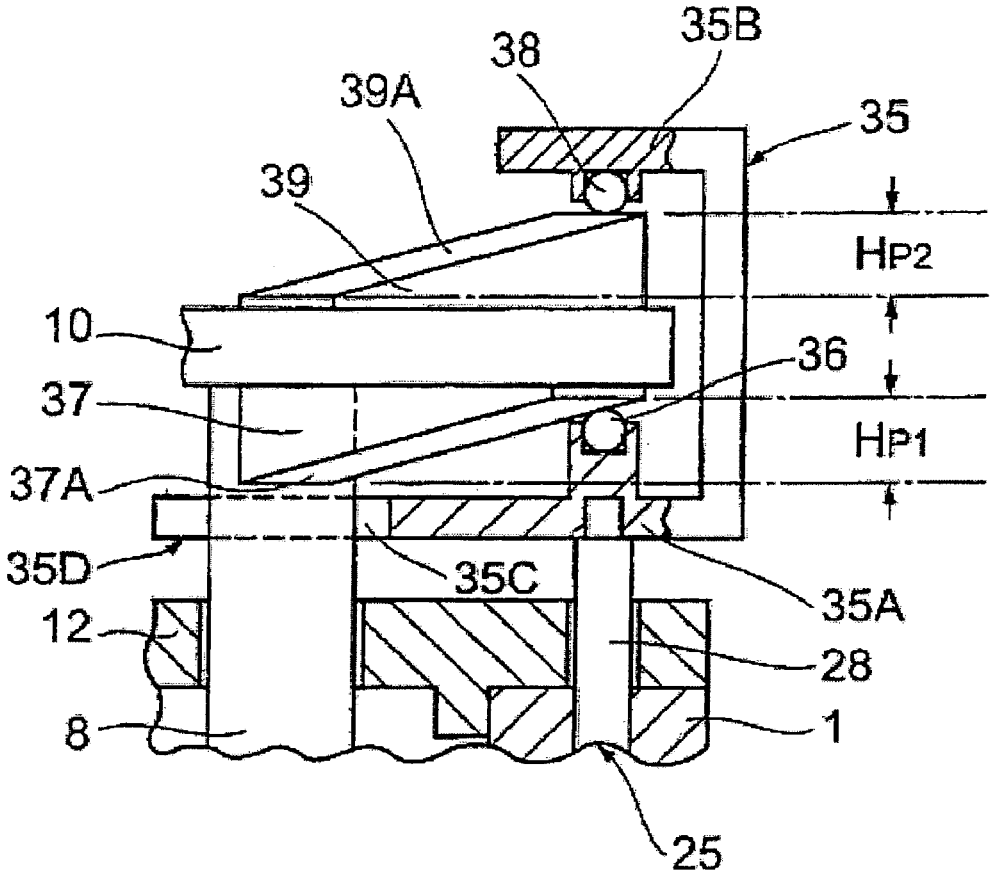
FIG. 2 is a cutaway front view showing another embodiment of the present invention.

FIG. 2 is a partial cutaway front view showing another embodiment of the present invention, in which the lower edge 35A of a driven member 35 with an inverted U-shape profile is fixedly attached to the upper end of the piston rod 28 of the acceleration pump 25. The piston rod is extended upward completely through the cover body 12 and is disposed parallel to the throttle valve stem 8 in the rotary throttle valve-type carburetor in the same manner as in FIG. 1.

In the driven member 35, the external circumferential portion of the throttle lever 10 is inserted between the lower edge 35A and the upper edge piece 35B, and a first contact portion 36 and second contact portion 38. The first and second contact portions 36 and 38 are positioned on the extended center axis line of the piston rod 28, are configured as rotatably mounted and held spheres, and are set facing each other. The lower edge 35A has a bifurcated end portion 35C. The throttle valve stem 8 is interposed to prevent the driven member 35 from rotating in concert with the turning of the throttle valve lever 10. The bifurcated end portion and throttle valve stem 8 constitute a direct-acting guide 35D for the piston rod 28.

A first cam 37 and a second cam 39, which comprise circular end cams centered about the throttle valve stem 8, are formed in a protruding configuration on the lower surface and upper surface of the throttle valve lever 10. These cam surfaces 37A and 39A are parallel to each other. The cam surface 37A of the first cam 37 faces the carburetor main body 1 and is brought into contact with the first contact portion 36. The cam surface 39A of the oppositely directed second cam 39 is brought into contact with the second contact surface 38.

During idling, the first contact portion 36 makes contact with the lowest portion of the second cam 37, and the second contact portion 38 makes contact with the highest portion of the second cam 39, as shown in FIG. 2. As a result, when the driver turns the throttle valve lever 10 by operating the accelerator, the piston rod 28 and the driven member 35 are pushed downward in association with the increase in height of the first cam 37, and acceleration fuel from the pump is delivered and supplied to the suction channel.

When the throttle valve lever 10 returns in the direction of the idling position due to the accelerator operation being lessened or released, fuel is suctioned to replenish the pump chamber by the second contact portion 38 pulling up the piston rod 28 and driven member 35 in association with the increase in height of the second cam 39.

According to the present embodiment, a piston spring indispensable to a conventional acceleration pump or the acceleration pump in the embodiment of FIG. 1 is unnecessary because two cams 37 and 39 perform the action of the acceleration pump 25, which includes a delivery stroke and a suction stroke. The length of the cylinder chamber, and the pump chamber in particular, can be shortened, the acceleration pump 25 can be made smaller, or the portions that slide within the cylinder chamber of the piston rod 28 and the piston can be extended and the stability of linear reciprocation can be ensured. Rendering the piston spring unnecessary also has the advantage of not increasing the load on the valve-closing spring 11, which works in the opposite direction. The driven portion 35 is disposed around a side portion of the throttle valve lever 10, and because it does not greatly project to the exterior of the carburetor, the entire carburetor is not significantly enlarged.

In the present embodiment, two contact portions 36 and 38 are kept in constant contact with the cam surfaces 37A and 39A. This approach allows the movements of the acceleration pump 25 to precisely follow the opening and closing action of the throttle valve. However, considering dimensional errors in components and deviations in assembly, it is actually preferable to make the space between the two contact portions 36 and 38 slightly larger than the space between the two cam surfaces 37A and 39A. Such a configuration reliably prevents the friction resistance from decreasing and acting in concert with the direct-acting guide 35D to bend the piston rod 28, and allows the acceleration pump to operate smoothly because the second contact portion 38 is maintained in a state slightly separated from the cam surface 39A of the second cam 39 when the throttle valve opens, and because the first contact portion 36 is maintained in a state slightly separated from the cam surface 37A of the first cam 37 when the throttle valve closes.

Figure 3:
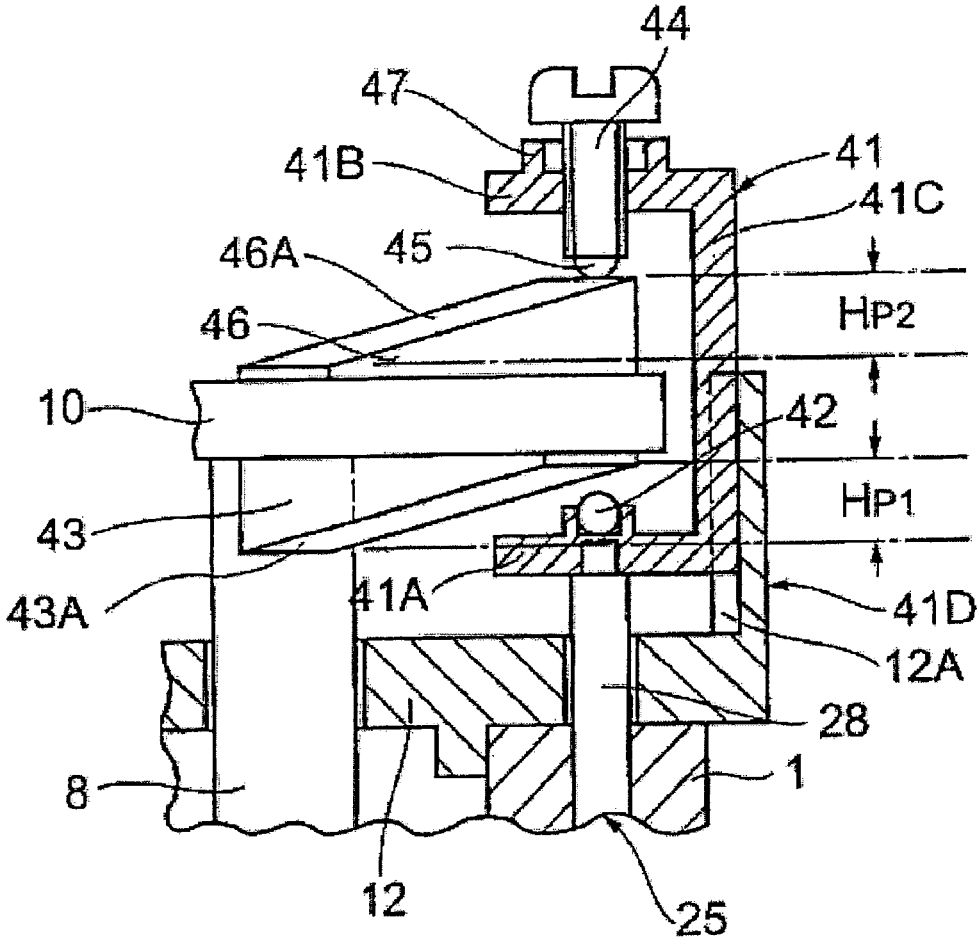
FIG. 3 is a partial cutaway front view showing yet another embodiment of the present invention.

FIG. 3 is a partial cutaway view showing yet another embodiment of the present invention, in which the lower edge 41A of a driven member 41 with an inverted U-shape profile is fixedly attached to the upper end of the piston rod 28 of the acceleration pump 25. The piston rod is extended upward completely through the cover body 12 and is disposed parallel to the throttle valve stem 8 in the rotary throttle valve-type carburetor in the same manner as in FIGS. 1 and 2.

In the driven member 41, the external circumferential portion of the throttle lever 10 is inserted between the lower edge 41A and the upper edge piece 41B, and the following components are set facing each other: a first contact portion 42 positioned on the extended center axis line of the piston rod 28 and configured as a sphere that is rotatably mounted and held on the lower edge 41A, and a hemispherical second contact portion 45 formed at the leading end of an adjustment screw 44, which is threadably mounted in the upper edge piece 41B. A vertically extending side edge 41C is fitted into a vertical guide groove 12A formed in the cover body 12 to prevent the driven member 41 from rotating in concert with the turning of the throttle valve lever 10. The side end 41C and guide groove 12A constitute a direct-acting guide 41D for the piston rod 28.

An annular stopper 47 that surrounds the adjustment screw 44 and protrudes upward is integrally provided to the upper edge piece 41B. The head of the adjustment screw 44 is configured to prevent excessive threadable insertion of the adjustment screw by making contact with the stopper 47. The stopper may be an annular piece separate from the upper edge piece 41B.

A first cam 43 and a second cam 46, which comprise circular end cams centered about the throttle valve stem 8, are formed in a protruding configuration on the lower surface and upper surface of the throttle valve lever 10. These cam surfaces 43A and 46A are parallel to each other, the cam surface 43A of the first cam 43 faces the carburetor main body 1 and is brought into contact with the first contact portion 42, and the cam surface 46A of the oppositely directed second cam 46 is brought into contact with the second contact surface 45.

FIG. 3 shows the state during idling, in which the first contact portion 42 is slightly separated downward from the lowest portion of the first cam 43. When the adjustment screw 44, which causes the second contact portion 45 to come into contact with the lowest portion of the second cam 46, is turned in the screw-in direction, the space between the two contact portions 42 and 45 is reduced and the first contact portion 42 moves to come into contact with the first cam 43. The stopper 47 prevents the drawback in which the adjustment screw 44 is excessively threadably inserted, causing both contact portions 42 and 45 to bite into the cam surfaces 43A and 46A, and resulting in reduced performance. When the adjustment screw 44 is turned in the removing direction, the space between the two contact portions 42 and 45 is increased and the first contact portion 42 further separates from the first cam 43.

When the throttle valve lever 10 is turned from the state shown in FIG. 3 by the driver operating the accelerator, the height of the second cam 46 that is in contact with the second contact portion 45 is reduced, the acceleration pump 25 is stopped in an inoperative position without being operated by friction resistance of the piston or piston rod 28, by the fuel pressure within the pump chamber, the channel resistance of the fuel, or the like, and the second contact portion 45 separates from the second cam 46. On the other hand, when the height of the first cam 43 increases, the cam surface 43A thereof comes into contact with the first contact portion 42, the piston rod 28 and the driven member 41 are thereafter pushed downward in association with the increasing height of the first cam 43, and acceleration fuel from the fuel chamber is delivered and supplied to the suction channel. The first cam 43 pushes the driven member 41 down, and the second contact portion 45 is thereafter held in a state separated by a fixed space from the cam surface 46A of the second cam 46.

When the accelerator operation is lessened or released, the throttle valve lever 10 returns in the direction of the idling position, the first contact portion 42 separates from the gradually lowering first cam 43, the piston rod 28 and the driven member 41 stop in the pressed-down position, and the gradually rising second cam 46 makes contact with the second contact portion 45 and then lifts the piston rod 28 and driven member 41 to suction in the fuel and fill the pump chamber.

The linear reciprocating movement of the acceleration pump 25 is performed by the two cams 43 and 46 in the present embodiment as well, so the same effects exhibited in the embodiment shown in FIG. 2 can be achieved, making it possible to provide a smaller acceleration pump 25, to ensure the stability of linear reciprocation, and to increase the size of the entire carburetor only slightly.

According to the present embodiment, the space between the two contact portions 42 and 45 is additionally made steplessly adjustable according to the depth of the threadable insertion of the adjustment screw 44. These portions can be arbitrarily adjusted from a state in which a maximum stroke is provided to the acceleration pump 25 in contact with the cams 43A and 46A, to a state in which the first contact portion 42 comes into contact with the first cam 43 in a position proximate to the one in which the throttle valve of the throttle valve lever 10 is completely open, and in which a minimum stroke is provided to the acceleration pump 25, allowing the acceleration fuel flow rate to be steplessly adjusted so as to correspond to a variety of engine demands.

In the embodiments in FIGS. 2 and 3, the difference in height $H_P$1 between the contact locations in the completely open positions and those in the idling positions of the cam surfaces 37A and 43A on these first cams 37 and 43 in relation to the first contact portions 36 and 42, and the difference in height $H_P$2 between the contact locations in the completely open positions and those in the idling positions of the cam surfaces 39A and 46A on these second cams 39 and 46 in relation to the second contact portions 38 and 45 must be mutually equal and greater than the movement quantity $H_T$ in the axial direction of the throttle valve stem 8 shown in FIG. 1. However, it is apparent in relation to a carburetor in which the throttle valve is a butterfly-type and the throttle valve stem does not move in the axial direction, that $H_P$ in FIG. 1 and $H_P$1 and $H_P$2 in FIGS. 2 and 3 need merely be set with consideration of the piston stroke of the acceleration pump 25 only, without regard to $H_T$.

Figure 4:
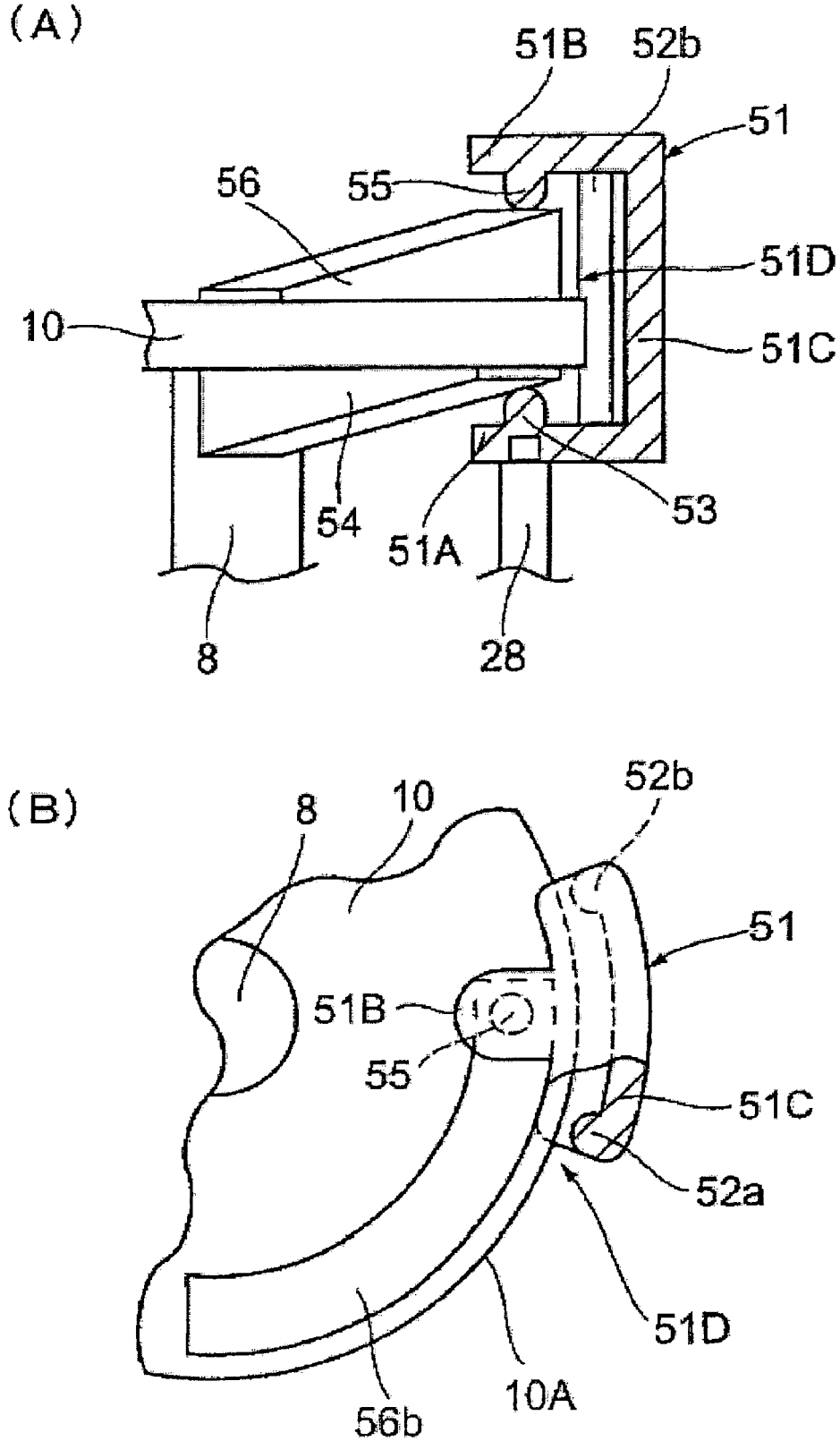
FIG. 4(A) is a partial cutaway front view, and (B) is a partial cutaway top view showing a different embodiment of the present invention.

Next, FIG. 4 shows yet another embodiment of the direct-acting guide for the piston rod in a device having two contact portions and two cams in the same manner as the embodiments of FIGS. 2 and 3.

The driven member 51 in this embodiment is configured such that the first contact portion 53 protrudes upward from the lower edge 51A, and the second contact portion 55 protrudes downward from the upper edge piece 51B, in the same manner as the driven members 35 and 41 described above. Protruding edges 52*a* and 52*b* facing the external circumference 10A of the throttle valve lever 10 are disposed with a small space therebetween on both sides of the side edge 51C of this driven piece 51. The two contact portions 53 and 55 are disposed on the extended center axis line of the piston rod 28. A first cam 54 that pushes the piston rod 28 downward and a second cam 56 that lifts it upward are formed on the lower surface and upper surface of the throttle valve lever 10, in the same manner as the embodiments of FIGS. 2 and 3. The region along the first cam 54 and the second cam 56 of the external circumference 10A of the throttle lever 10 is made circular with the throttle valve stem 8 as the center, and the two protruding edges 52*a* and 52*b* are configured so as to be constantly facing the circular portion when the throttle lever 10 turns between the idling position and the completely open position.

When the throttle lever 10 turns, the first contact portion 53, which is in contact with the first cam 54, and the second contact portion 55, which is in contact with the second cam 56, move in the turning direction and attempt to pull and rotate the driven member 51, one of the protruding edges 52*a* and 52*b* stops the co-rotation by making contact with the external circumference 10A, and the piston rod 28 linearly reciprocates without bending even when the throttle valve rotates in either the opening direction or the closing direction. In other words, the circular external circumference 10A and the two protruding edges 52*a* and 52*b* in the present embodiment constitute a direct-acting guide 51D for the piston rod 28.

In the implementation of the present invention, the cam 33 of FIG. 1, the first cams 37, 43, and 54, and the second cams 39, 46, and 56 in FIGS. 2 to 4 may be attached to the throttle valve stem 8 as respectively independent components, but attaching these to the throttle valve lever 10 as in the depicted embodiments has advantages in that the throttle valve stem 8 need not largely protrude from the carburetor main body, and the size of entire carburetor is not significantly increased.

As described above, according to the present invention, a piston-type accelerator pump can be linked to the throttle valve and operated in a simple configuration that dispenses with a link mechanism and does not greatly enlarge the carburetor. An accelerator particularly suitable for the carburetors of general-purpose engines can be obtained without concern of impairing the function of the carburetor.

What is claimed is:

1. An acceleration apparatus for a carburetor having a piston-type acceleration pump linked to a throttle valve, said acceleration apparatus for a carburetor comprising:

a throttle valve stem having a portion that protrudes to the exterior of a carburetor main body and includes a cam whose circular shape is centered about the throttle valve stem and whose cam surface faces the carburetor main body;

an acceleration pump having a piston rod extending from a piston mounted in a cylinder chamber formed inside the carburetor main body to the exterior of the carburetor main body and is disposed parallel to the throttle valve stem; and wherein acceleration fuel is delivered and supplied to a suction channel from the cylinder chamber by the cam pushing the piston rod along the cam surface as the throttle valve rotates in the opening direction of the throttle valve stem.

2. The acceleration apparatus for a carburetor according to claim 1, wherein the cam is formed on the throttle valve lever.

3. The acceleration apparatus for a carburetor according to claim 1, wherein the carburetor is a rotary throttle valve-type carburetor, and the cam has a difference in height greater than a quantity of axial movement of the throttle valve between an idling position and a completely open position.

4. The acceleration apparatus for a carburetor according to claim 2, wherein the carburetor is a rotary throttle valve-type carburetor, and the cam has a difference in height greater than a quantity of axial movement of the throttle valve between an idling position and a completely open position.

5. The acceleration apparatus for a carburetor according to claim 1, wherein the piston rod is kept in constant contact with the cam surface of the cam by a piston spring inserted in the cylinder chamber.

6. The acceleration apparatus for a carburetor according to claim 2, wherein the piston rod is kept in constant contact with the cam surface of the cam by a piston spring inserted in the cylinder chamber.

7. The acceleration apparatus for a carburetor according to claim 3, wherein the piston rod is kept in constant contact with the cam surface of the cam by a piston spring inserted in the cylinder chamber.

8. The acceleration apparatus for a carburetor according to claim 4, wherein the piston rod is kept in constant contact with the cam surface of the cam by a piston spring inserted in the cylinder chamber.

9. The acceleration apparatus for a carburetor according to claim 1, wherein the piston rod rotatably holds a sphere for contacting the cam surface, and the sphere causes the piston rod to move linearly while rolling in contact with the cam surface.

10. The acceleration apparatus for a carburetor according to claim 1, comprising direct-acting guides for providing linear reciprocating movement to the piston rod.

11. The acceleration apparatus for a carburetor according to claim 2, comprising direct-acting guides for providing linear reciprocating movement to the piston rod.

12. The acceleration apparatus for a carburetor according to claim 3, comprising direct-acting guides for providing linear reciprocating movement to the piston rod.

13. The acceleration apparatus for a carburetor according to claim 4, comprising direct-acting guides for providing linear reciprocating movement to the piston rod.

14. An acceleration apparatus for a carburetor having a piston-type acceleration pump linked to a throttle valve, said acceleration apparatus for a carburetor comprising a carburetor main body, a throttle valve stem inside the carburetor main body, a cam centered about the throttle valve stem and whose cam surface faces the carburetor main body;

an acceleration pump having a piston rod extending from a piston mounted in a cylinder chamber and disposed parallel to the throttle valve stem; and a suction channel in fluid communication with the cylinder chamber.

15. The acceleration apparatus for the carburetor of claim 14 wherein acceleration fuel is delivered and supplied to the suction channel from the cylinder chamber by the cam pushing the piston rod along the cam surface as the throttle valve rotates.

16. The acceleration apparatus for the carburetor of claim 15 wherein the throttle valve rotates in the opening direction of the throttle valve stem.

17. The acceleration apparatus for the carburetor of claim 14 wherein a portion of the throttle valve stem protrudes to the exterior of the carburetor main body.

18. The acceleration apparatus for a carburetor according to claim 14, wherein the cam is formed on the throttle valve stem.

19. The acceleration apparatus for a carburetor according to claim 14, wherein the carburetor is a rotary throttle valve-type carburetor, and the cam has a difference in height greater than a quantity of axial movement of the throttle valve between an idling position and a completely open position.

20. The acceleration apparatus for a carburetor according to claim 18, wherein the carburetor is a rotary throttle valve-type carburetor, and the cam has a difference in height greater than a quantity of axial movement of the throttle valve between an idling position and a completely open position.

21. The acceleration apparatus for a carburetor according to claim 14, wherein the piston rod is kept in constant contact with the cam surface of the cam by a piston spring inserted in the cylinder chamber.

22. The acceleration apparatus for a carburetor according to claim 18, wherein the piston rod is kept in constant contact with the cam surface of the cam by a piston spring inserted in the cylinder chamber.

23. The acceleration apparatus for a carburetor according to claim 19, wherein the piston rod is kept in constant contact with the cam surface of the cam by a piston spring inserted in the cylinder chamber.

24. The acceleration apparatus for a carburetor according to claim 20, wherein the piston rod is kept in constant contact with the cam surface of the cam by a piston spring inserted in the cylinder chamber.

25. The acceleration apparatus for a carburetor according to claim 14, wherein the piston rod rotatably holds a sphere for contacting the cam surface, and the sphere causes the piston rod to move linearly while rolling in contact with the cam surface.

26. The acceleration apparatus for a carburetor according to claim 14, comprising direct-acting guides for providing linear reciprocating movement to the piston rod.

27. The acceleration apparatus for a carburetor according to claim 18, comprising direct-acting guides for providing linear reciprocating movement to the piston rod.

28. The acceleration apparatus for a carburetor according to claim 19, comprising direct-acting guides for providing linear reciprocating movement to the piston rod.

29. The acceleration apparatus for a carburetor according to claim 20, comprising direct-acting guides for providing linear reciprocating movement to the piston rod.

* * * * *